US008104939B2

(12) United States Patent
Coushaine et al.

(10) Patent No.: US 8,104,939 B2
(45) Date of Patent: Jan. 31, 2012

(54) LED HEADLAMP SYSTEM

(75) Inventors: Charles M. Coushaine, Rindge, NH (US); Angela Hohl-Abichedid, Clarks Summit, PA (US); Ralph Johnson, Bedford, NH (US); William E. Meyer, Lincoln, MA (US); Thomas Reiners, Bachhagel (DE); Thomas Tessnow, Weare, NH (US); Michael Tucker, Henniker, NH (US); Ralf Vollmer, Ulm (DE)

(73) Assignee: OSRAM SYLVANIA Inc., Danvers, MA (US)

( * ) Notice: Subject to any disclaimer, the term of this patent is extended or adjusted under 35 U.S.C. 154(b) by 506 days.

(21) Appl. No.: 11/991,013

(22) PCT Filed: Aug. 23, 2006

(86) PCT No.: PCT/US2006/032751

§ 371 (c)(1),
(2), (4) Date: Feb. 5, 2009

(87) PCT Pub. No.: WO2007/027474

PCT Pub. Date: Mar. 8, 2007

(65) Prior Publication Data

US 2009/0213606 A1 Aug. 27, 2009

Related U.S. Application Data

(60) Provisional application No. 60/712,772, filed on Aug. 31, 2005.

(51) Int. Cl.

| | |
|---|---|
| ***F21V 9/00*** | (2006.01) |
| ***F21V 21/00*** | (2006.01) |
| ***F21S 8/00*** | (2006.01) |

(52) U.S. Cl. ..... 362/511; 362/545

(58) Field of Classification Search ..... 362/615, 362/616, 555, 475, 498, 499, 507, 511, 540–545, 362/249.02, 235, 613, 244, 249.11, 311.01, 362/311.02, 311.06, 299, 326, 331, 332
See application file for complete search history.

(56) References Cited

U.S. PATENT DOCUMENTS 5,590,945 A * 1/1997 Simms ..... 362/623

(Continued)

FOREIGN PATENT DOCUMENTS

EP 1 388 461 11/2004

(Continued)

OTHER PUBLICATIONS

Supplementary European Search Report and Annex on European Patent Application No. 06 78 9927, mailed Jul. 8, 2009.

*Primary Examiner* — Anabel Ton
*Assistant Examiner* — Danielle Allen
(74) *Attorney, Agent, or Firm* — Edward S. Podszus

(57) ABSTRACT

A solid-state light source (10) comprising a plurality of LED units (12) arrayed to emit light generally about an axis (14). Each of the LED units (12) can comprise a number of LEDs, for example, up to five. They may all emit in a single color or multiple colors can be combined for a specific effect. A light transmissive light guide (16) is associated with the LED units (12) and has a plurality of input widows (18). Each LED unit (12) faces a respective input window (18) and each window (18) transversely intercepts the axis (14) and receives light from the LED units (12). The input windows (18) lead to a common output window (20) that is axially aligned with the input windows (18). The light guide (16) has smooth side-walls (22) that extend between the input windows (18) and the output window (20).

18 Claims, 3 Drawing Sheets

U.S. PATENT DOCUMENTS

| | | | | |
|---|---|---|---|---|
| 5,895,115 | A * | 4/1999 | Parker et al. | 362/511 |
| 6,318,863 | B1 | 11/2001 | Tiao et al. | |
| 6,443,582 | B1 * | 9/2002 | Tarne et al. | 362/27 |
| 6,527,411 | B1 | 3/2003 | Sayers | |
| 6,955,439 | B2 * | 10/2005 | Reismiller et al. | 362/36 |
| 7,286,296 | B2 * | 10/2007 | Chaves et al. | 359/641 |
| 2004/0047161 | A1 * | 3/2004 | Mochizuki et al. | 362/511 |
| 2006/0061286 | A1 * | 3/2006 | Coushaine et al. | 315/76 |
| 2006/0087861 | A1 * | 4/2006 | Tessnow et al. | 362/538 |
| 2006/0239024 | A1 * | 10/2006 | Valcamp et al. | 362/545 |

FOREIGN PATENT DOCUMENTS

| | | |
|---|---|---|
| GB | 2 365 962 | 2/2002 |
| WO | 2004059348 | 7/2004 |

* cited by examiner

LED HEADLAMP SYSTEM

CROSS-REFERENCE TO RELATED APPLICATIONS

The Applicants hereby claim the benefit of their provisional application, Ser. No. 60/712,772 filed Aug. 31, 2005 for LED Headlamp System.

TECHNICAL FIELD

This invention relates to light sources and more particularly to solid-state light sources. Still more particularly it relates to solid-state light sources that can be employed in a headlamp to mimic the light distribution pattern of an incandescent light. Still more particularly, it relates to solid-state light sources useable as automotive headlamp lighting.

BACKGROUND ART

LEDs are now being used in a variety of lighting application, both for efficiency and durability. One of the most difficult lighting applications is automotive head lighting, and there is a drive to use LEDs in headlamps because of their long life and ruggedness. Good luminance is required, but LED are significantly less luminous than tungsten halogen filaments or arc discharges; therefore, a plurality of LEDs must be used to generate the total number of lumens required. This may be achieved by ganging a plurality of LEDs together, but dispersed light sources are difficult to optically integrate, and forward automotive lighting requires excellent beam direction. There is then a need for an LED headlamp system with sufficient lumens and good beam structure. It is possible to achieve the headlight function by dispersing LEDs over a great area. This helps resolve the problem of excessive heating, but it exaggerates the beam building and optical problems by requiring beam alignments from differing directions. It also forces the housing and support structures to be large, cumbersome and expensive. There is then a need for an optically compact LED head lighting system.

DISCLOSURE OF THE INVENTION

It is, therefore, an object of the invention to obviate the disadvantages of the prior art.

It is another object of the invention to enhance LED headlamps.

These objects are accomplished, in one aspect of the invention, by the provision of a solid-state light source that comprises a plurality of LED units arrayed to emit light generally about an axis. A light transmissive light guide has a plurality of input widows with each LED unit facing a respective input window. Each window transversely intercepts the axis and receives light from the LED units. A common output window is axially aligned with the input windows. The light guide has smooth sidewalls extending between the input windows and the output window and a lens is axially aligned with the output window and has a focal point positioned relative to the output window to refract light received from the output window into a preferred beam pattern directed to a field to be illuminated. An electrical connector provides power from an external source to energize the LED units, and a housing retains the LED units, light guide, lens and electrical connector in proper relation.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
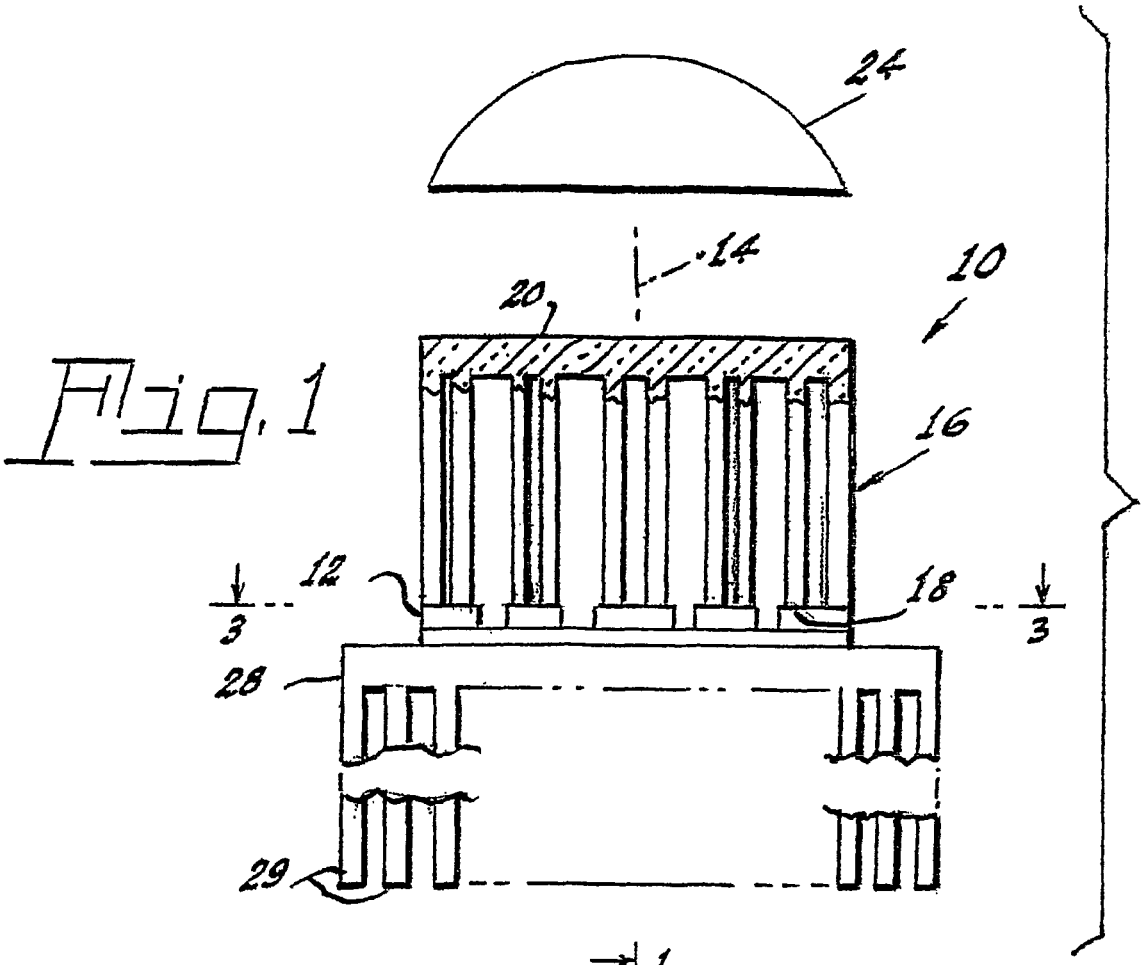
FIG. 1 is a diagrammatic, front elevational view of an embodiment of the invention, taken along the line 1-1 of FIG. 3.

Referring now to the drawings with greater particularity, there is shown in FIG. 1 a solid-state light source 10 comprising a plurality of LED units 12 arrayed to emit light generally about an axis 14. Each of the LED units 12 can comprise a number of LEDs, for example, up to five. They may all emit in a single color or multiple colors can be combined for a specific effect. A light transmissive light guide 16 is associated with the LED units 12 and has a plurality of input widows 18. Each LED unit 12 faces a respective input window 18 and each window 18 transversely intercepts the axis 14 and receives light from the LED units 12. The input windows 18 lead to a common output window 20 that is axially aligned with the input windows 18. The light guide 16 has smooth sidewalls 22 that extend between the input windows 18 and the output window 20 to enhance total internal reflection in the light guide 16.

A lens 24 is axially aligned with the output window 20 and has a focal point positioned relative to the output window to refract light received from the output window 20 into a preferred beam pattern directed to a field to be illuminated.

An electrical connector 26 provides power from an external source to energize the LED units.

A housing 28, which can also function as a heatsink, retains the LED units 12, the light guide 16, the lens 24 and electrical connector 26 in proper relation. To increase the heatsinking function, a plurality of heat-radiating fins 29 can be provided on the housing 28.

In a preferred embodiment of the invention, the output window 20 has an area less than 40 square millimeters.

Figure 5:
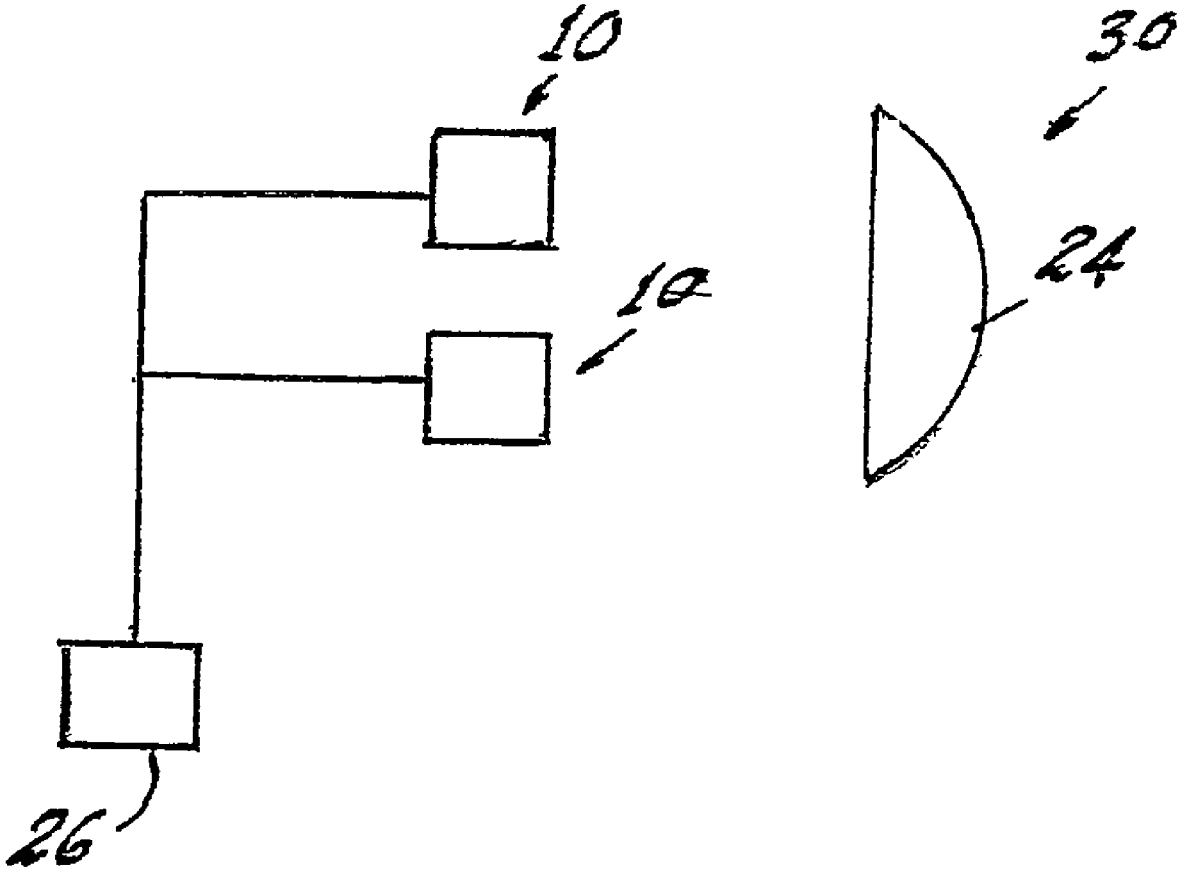
FIG. 5 is a diagrammatic view of an embodiment of an automotive headlamp.

A vehicle lamp system 30, shown diagrammatically in FIG. 5, can comprise a plurality of solid-state light sources 10, with different sources being formed to provide different light outputs, for example, on light source 10 can provide a high beam and one can provide a low beam.

Further, the light sources can be configured to provide beam spread functions, hot spot beam functions, etc.

Figure 2:
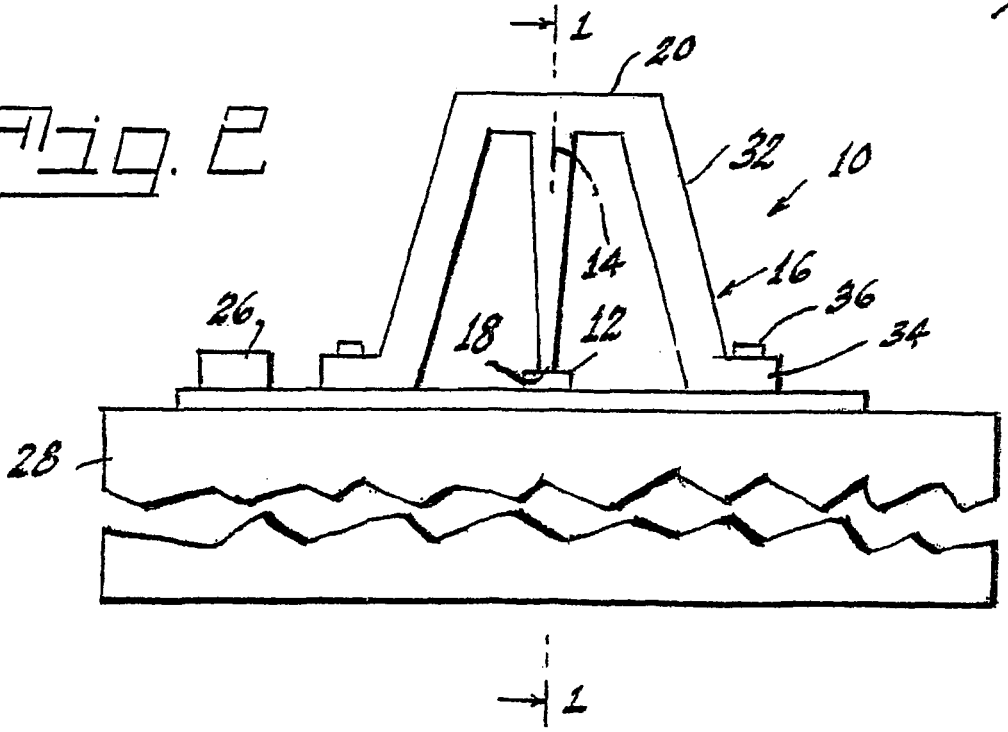
FIG. 2 is a diagrammatic, side elevational view of the embodiment of FIG. 1.
Figure 3:
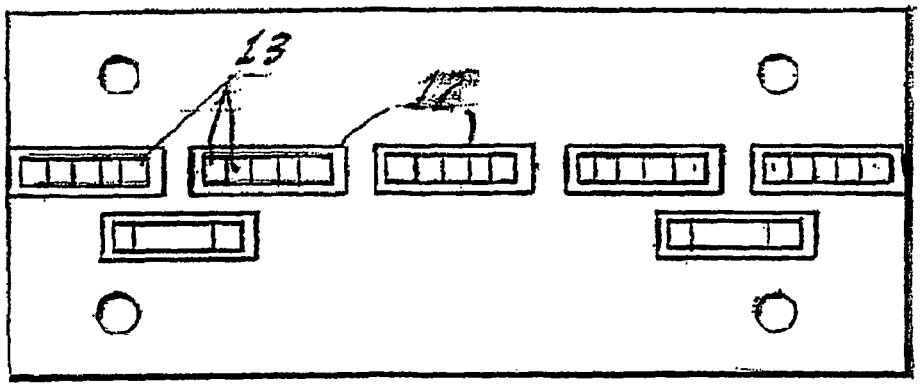
FIG. 3 is plan view of an embodiment of the invention taken along the line 3-3 of FIG. 1.
Figure 4:
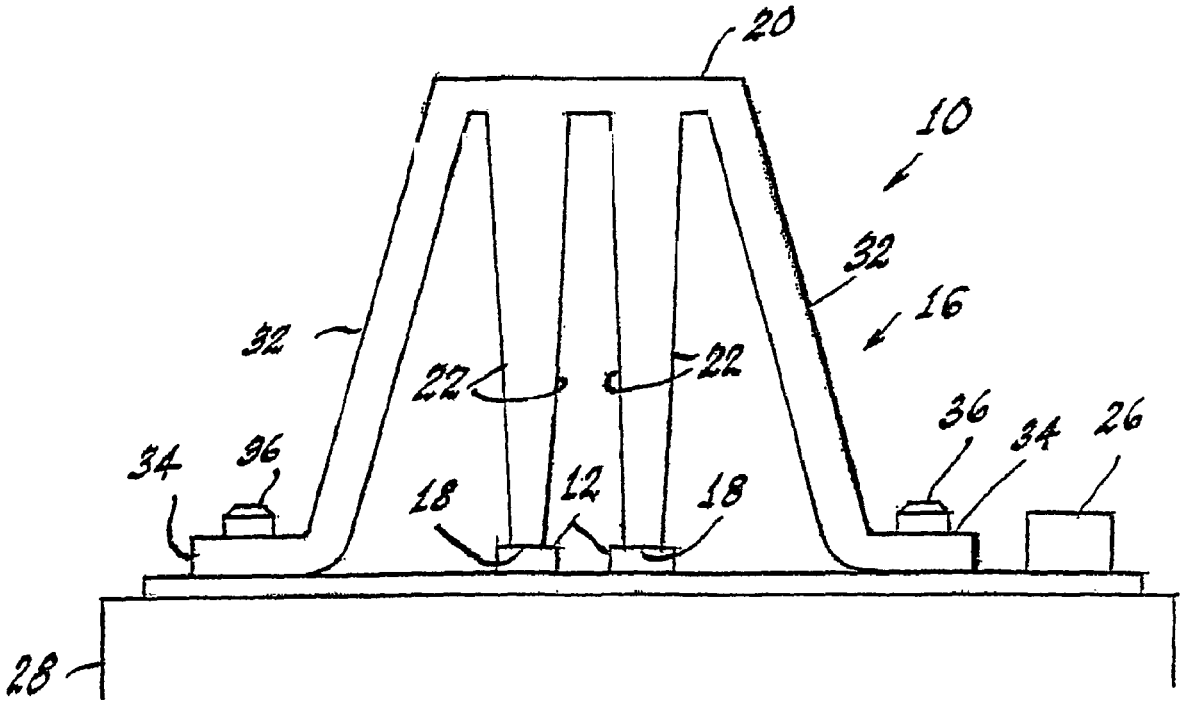
FIG. 4 is a side elevational view of the embodiment of FIG. 3 with a light guide in place.

The LED units 12 can be contained in ceramic fixtures mounted directly on a printed circuit board. The units 12 are preferably arranged in one or two lines, as shown in FIGS. 2 and 3.

The light guide 16 is formed from a light transmissive material. Glass or plastic, such as polycarbonate may be used. The preferred material is moldable so as to inexpensively take the preferred optical form. The light guide has one or more input widows 18 transversely intercepting the beam axis 14 to face the one or more LED units 12 and receive light from the one or more LEDs. In the preferred embodiment, there is one light guide input window 18 for each LED unit 12. If desired, two or more LED units 12 could be directed into a particular input window 18. The preferred individual input windows 18 then span a respective one of the LED unit's output region to capture a substantial part of the emitted light. If there are five LED units 12, for example, in the beam function array, then there are five separate input windows 18, each one closely positioned to span the emission region of the corresponding LED unit. Alternatively, the input window could span all of the LEDs in an array. For example, if five LED units make up the horizontal band of the high beam spread function, the one input window, would have a horizontal width slightly greater than five times the LED unit width plus the gap between the adjacent LED units to thereby span the output regions of the five LED units.

The light guide 16 includes a common output window 20 axially aligned with the input window or windows 18, and spanning the plurality of input windows. The common output window 20, in the preferred embodiment, has a greater area than the input window areas, but is still preferably sized to mimic a filament. In general it is desirable to have as small an output window as possible, ultimately creating an ideal optical point source. Unfortunately, a small output window cuts off the amount of light passed, and transmission has to be balanced against optical size. The light guide 16 has smooth sidewalls extending between the input window and the output window to enable total internal reflection.

Supporting legs 32 position the light guide 16 in position on the housing 28, for example, by flanges 34 that can receive bolts 36. The light guide 16 may formed to bridge the LEDs 12, then be anchored by the legs 32 to the housing 28 so as to securely and accurately fix the input windows 18 adjacent the LEDs 12. In the preferred embodiment, the light guide with input windows, output window and the support (legs 32) is a unitary body molded from a light transmissive material that is anchored to the substrate supporting the array of LEDs, thereby accurately fixing the input windows in a face to face relation with the respective LEDs.

Overall, this gives the preferred light guide the. form of a plurality of tapered portions with their respective narrow input windows 18 facing their respective light supplying LED units 12, while the broader output ends are merged together as a single output window 20. The preferred sidewall angle(s) from the respective input windows to the common output window correspond to the beam angle for that particular beam function. There may then be light guides with a high and low beam hot spot angles, high and low beam spread angles. Similarly there may be light guides for bending beam functions; that is to say, dynamic turning lighting or advance forward lighting system lighting, and also fog lamp, signaling, daylight running, marker or other functions where the spread (height and width angles) of the desired beam are initiated in the light guide structure. It is also desirable to include other beam features that smooth, fill in or style the look of the headlamp. All of these differing functions can be accommodated in the plurality of light source assemblies.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A solid-state light source (10) comprising:

a plurality of LED units (12) arrayed to emit light generally about an axis (14);

a light transmissive light guide (16) having a plurality of input widows (18), each LED unit (12) facing a respective input window (18), each input window (18) transversely intercepting the axis (14) and receiving light from the LED units (12); and a common output window (20) axially aligned with the input windows (18), the light guide (16) having smooth sidewalls extending between the input windows (18) and the output window (20);

a lens (24) axially aligned with the output window (20) and having a focal point positioned relative to the output window (20) to refract light received from the output window (20) into a preferred beam pattern directed to a field to be illuminated;

an electrical connector (26) providing power from an external source to energize said LED units (12), and a housing (28) to retain the LED units (12), the light guide (16), the lens (24) and the electrical connector (26) in proper relation, and wherein the light guide (16) comprises supporting legs (32) to position the light guide (16) relative the housing (28), and the light guide (16) is formed to bridge the LED units (12) and is anchored by the supporting legs (32) to the housing (28); and wherein the output window has an area less than 40 square millimeters.

2. The light source in claim 1, wherein said light guide (16) with input windows (18), the output window (20) and the supporting legs (32) is a unitary body molded from a light-transmissive material.

3. The solid-state light source of claim 1, wherein the supporting legs (32) are each at positions spaced from the LED units (12).

4. A vehicle lamp system comprising, a plurality of solid-state light sources, each light source having: at least one LED unit containing at least one LED arrayed to emit light generally about an axis; and a light transmissive light guide having at least one input window transversely intercepting the axis to face the at least one LED unit and receive light from the at least one LED; and a common output window axially aligned with the at least one input window, the light guide having smooth sidewalls extending between the at least one input window and the output window; and a lens axially aligned with the output window and having a focal point positioned relative to the output window to refract light received from the output window into a preferred beam pattern directed to a field to be illuminated;

an electrical connector providing power from an external source to energize said at least one LED unit, and a housing to retain the LED units, the light guide, the lens and the electrical connector in proper relation, and wherein the light guide comprises supporting legs to position the light guide relative the housing, and the light guide is formed to bridge the at least one LED unit and is anchored by the supporting legs to the housing, and wherein the at least one solid-state light source provides a high beam function.

5. The vehicle lamp system in claim 4, wherein the light guide with the at least one input window, the output window and the supporting legs is a unitary body molded from a light-transmissive material.

6. The vehicle lamp system in claim 4, wherein the supporting legs (32) are each at positions spaced from the at least one LED unit.

7. A vehicle lamp system comprising, a plurality of solid-state light sources, each light source having: at least one LED unit containing at least one LED arrayed to emit light generally about an axis; and a light transmissive light guide having at least one input window transversely intercepting the axis to face the at least one LED unit and receive light from the at least one LED; and a common output window axially aligned with the at least one input window, the light guide having smooth sidewalls extending between the at least one input window and the output window; and a lens axially aligned with the output window and having a focal point positioned relative to the output window to refract light received from the output window into a preferred beam pattern directed to a field to be illuminated;

an electrical connector providing power from an external source to energize said at least one LED unit, and a housing to retain the LED units, the light guide, the lens and the electrical connector in proper relation, and wherein the light guide comprises supporting legs to position the light guide relative the housing, and the light guide is formed to bridge the at least one LED unit and is anchored by the supporting legs to the housing, and wherein the at least one solid-state light source provides a low beam function.

8. The vehicle lamp system in claim 7, wherein the supporting legs (32) are each at positions spaced from the at least one LED unit.

9. A vehicle lamp system comprising, a plurality of solid-state light sources, each light source having: at least one LED unit containing at least one LED arrayed to emit light generally about an axis; and a light transmissive light guide having at least one input window transversely intercepting the axis to face the at least one LED unit and receive light from the at least one LED; and a common output window axially aligned with the at least one input window, the light guide having smooth sidewalls extending between the at least one input window and the output window; and a lens axially aligned with the output window and having a focal point positioned relative to the output window to refract light received from the output window into a preferred beam pattern directed to a field to be illuminated;

an electrical connector providing power from an external source to energize said at least one LED unit, and a housing to retain the LED units, the light guide, the lens and the electrical connector in proper relation, and wherein the light guide comprises supporting legs to position the light guide relative the housing, and the light guide is formed to bridge the at least one LED unit and is anchored by the supporting legs to the housing, and wherein the at least one solid-state light source provides a spread beam function.

10. The vehicle lamp system in claim 9, wherein the supporting legs (32) are each at positions spaced from the at least one LED unit.

11. A vehicle lamp system comprising, a plurality of solid-state light sources, each light source having: at least one LED unit containing at least one LED arrayed to emit light generally about an axis; and a light transmissive light guide having at least one input window transversely intercepting the axis to face the at least one LED unit and receive light from the at least one LED; and a common output window axially aligned with the at least one input window, the light guide having smooth sidewalls extending between the at least one input window and the output window; and a lens axially aligned with the output window and having a focal point positioned relative to the output window to refract light received from the output window into a preferred beam pattern directed to a field to be illuminated;

an electrical connector providing power from an external source to energize said at least one LED unit, and a housing to retain the LED units, the light guide, the lens and the electrical connector in proper relation, and wherein the light guide comprises supporting legs to position the light guide relative the housing, and the light guide is formed to bridge the at least one LED unit and is anchored by the supporting legs to the housing, and wherein the at least one solid-state light source provides a hot spot beam function.

12. The vehicle lamp system in claim 11, wherein the supporting legs (32) are each at, positions spaced from the at least one LED unit.

13. A vehicle lamp system comprising, a plurality of solid-state light sources, each light source having: at least one LED unit containing at least one LED arrayed to emit light generally about an axis; and a light transmissive light guide having at least one input window transversely intercepting the axis to face the at least one LED unit and receive light from the at least one LED; and a common output window axially aligned with the at least one input window, the light guide having smooth sidewalls extending between the at least one input window and the output window; and a lens axially aligned with the output window and having a focal point positioned relative to the output window to refract light received from the output window into a preferred beam pattern directed to a field to be illuminated;

an electrical connector providing power from an external source to energize said at least one LED unit, and a housing to retain the LED units, the light guide, the lens and the electrical connector in proper relation, and wherein the light guide comprises supporting legs to position the light guide relative the housing, and the light guide is formed to bridge the at least one LED unit and is anchored by the supporting legs to the housing, and wherein the at least one solid-state light source provides a bending beam function.

14. The vehicle lamp system in claim 13, wherein the supporting legs (32) are each at positions spaced from the at least one LED unit.

15. A solid-state light source comprising:

a plurality of LED units arrayed on a substrate to emit light generally about an axis; and a unitary light transmissive light guide having a plurality of input widows, each LED unit facing a respective input window, each input window transversely intercepting the axis and receiving light from the LED units; and a common output window axially aligned with the input windows, the light guide having smooth sidewalls extending between the input windows and the output window; and the unitary light guide comprising a support fixed relative to the substrate to locate the and retain the input windows in fixed relation to the respective LED units, wherein the support comprises supporting legs (32) to position the light guide relative the substrate, and the light guide is formed to bridge the LED units and is anchored by the supporting legs to the substrate, and wherein the output window has an area less than 40 square millimeters.

16. The solid-state light source in claim 15, further comprising a lens axially aligned with the output window and having a focal point positioned relative to the output window to refract light received from the output window into a preferred beam pattern directed to a field to be illuminated;

an electrical connector providing power from an external source to energize said LED units, and a housing to retain the LED units, the light guide, the lens and the electrical connector in proper relation.

17. The light source in claim 15, wherein the light guide with input windows, the output window and the supporting legs is a unitary body molded from a light transmissive material.

18. The vehicle lamp system in claim 15, wherein the supporting legs (32) are each at positions spaced from the LED units.

* * * * *